United States Patent [19]

Milianowicz et al.

[11] 3,932,715

[45] Jan. 13, 1976

[54] HIGH VOLTAGE SWITCH

[75] Inventors: Stanislaw A. Milianowicz, Monroeville; Steven J. Swencki, Jr., Trafford, both of Pa.

[73] Assignee: Westinghouse Electric Corporation, Pittsburgh, Pa.

[22] Filed: May 3, 1974

[21] Appl. No.: 466,745

[52] U.S. Cl. ..... 200/48 SB; 403/103; 74/525; 74/559

[51] Int. Cl.[2] ..... H01H 31/00

[58] Field of Search ..... 403/103; 74/525, 559, 579, 74/595; 200/48 R, 48 SB, 48 RP

[56] References Cited

UNITED STATES PATENTS 1,905,784 4/1933 Alsaker et al. ..... 403/103

1,930,728 10/1933 Ringling ..... 74/559 X

FOREIGN PATENTS OR APPLICATIONS 15,281 5/1903 United Kingdom

*Primary Examiner*—Herman J. Hohauser

*Attorney, Agent, or Firm*—R. E. Converse, Jr.

[57] ABSTRACT

A high voltage switch including a rotatable insulating column adjusted by means of an operating arm assembly including two bolt circles of equal radius and unequal spacing.

6 Claims, 9 Drawing Figures

HIGH VOLTAGE SWITCH

CROSS REFERENCES TO RELATED APPLICATIONS

This invention is related to the inventions disclosed in copending application Ser. No. 468,332, by Russell E. Frink and Stanislaw A. Milianowicz filed May 8, 1974, copending application Ser. No. 469,586 by Stanislaw A. Milianowicz filed May 13, 1974, copending application Ser. No. 469,932 by Russell E. Frink, filed May 14, 1974, copending application Ser. No. 469,931 by Stanislaw A. Milianowicz and Russell E. Frink filed May 14, 1974, copending application Ser. No. 396,163 by Russell E. Frink and Stanislaw A. Milianowicz, filed Sept. 11, 1973, copending application Ser. No. 292,209 by Charles M. Cleaveland filed Sept. 25, 1972, and copending application Ser. No. 458,255 by Stanislaw A. Milianowicz filed Apr. 5, 1974; all of which are assigned to the assignee of the present invention.

BACKGROUND OF THE INVENTION

1. Field of the Invention:

This invention relates to electrical apparatus and, more particularly, to high voltage switches.

2. Description of the Prior Art:

Switches for control of high voltage electricity are widely used by industry and electrical utilities. In a common design, the line terminals and separable contacts are at high potential and are supported by insulating columns, one of which is rotatable. Mechanical energy to operate the separable contacts is provided by a motor-drive and is transmitted to the contacts by means of a linkage coupled to the rotatable insulating column. Field conditions may require that a standard design switch have its motor-drive placed in any of a variety of positions. Means must therefore be provided for field assembly and adjustment of the coupling between the linkage and the rotatable insulating column.

In U.S. Pat. No. 1,905,784 there is described an adjustable operating lever for a high voltage switch which employs a lever with a semicircular clamp surface and a separable heel price cooperating with a polygonal shaft attached to a rotatable insulating column. However, positive positioning of the operating lever at a specific angle on the shaft is not provided by this lever. Another device used in the prior art is a two-piece assembly including a bolt circle in each piece, each circle of the same radius, with a large number of holes equally spaced in each circle. The pieces are placed in the desired relationship and bolted together. This method provides positive positioning, but to provide adjustment increments of, say, four degrees, it is necessary that 90 holes be placed in each bolt circle. In order for the bolt holes to be of adequate size, this method requires bolt circles of large radius and correspondingly large assembly members. This increases rotational inertia of the insulating column and slows switch operation. In addition, it is not always possible to assure a symmetrical pattern of connecting bolts, thereby introducing undesirable stress concentrations.

Another coupling method employs a shaft attached to the rotatable insulating column and extending through a lever with a toothed surface. The lever is positioned at the desired angle and clamped tightly against a cooperating toothed surface on the rotatable insulating column. The toothed surfaces are expensive, however, and require casting or machining.

Some mechanical linkages, such as that described in British Pat. No. 15,281 of 1902, have included methods providing a limited amount of adjustment, utilizing two series of equally spaced holes, the spacing of one series being unequal to the spacing of the other series. However, the mechanism taught by this patent also provides an asymmetrical bolt pattern. It would be desirable to provide a high voltage switch with an operating arm adjustable 360° around a rotating insulator column with small adjustment increments, positive positioning, symmetrical bolt pattern, and of simple, lightweight, low-cost construction.

SUMMARY OF THE INVENTION

There is provided a high voltage switch including separable contact means, a rotatable insulating column supporting the separable contact means, rotation of the insulating column producing separation of the contact means, drive means, linkage means connected to the drive means, and an arm assembly comprising an operating arm connected to the linkage means. The operating arm includes a first series of holes equally spaced along a first arc. The arm assembly also comprises a flange member attached to the rotatable insulating column and having a second series of holes equally spaced along a second arc of radius substantially equal to the first arc. The spacing of the first series of holes is unequal to the spacing of the second series of holes. The operating arm is attached to the flange member and so positioned that the centers of the first and second arcs are in axial alignment and at least two of the first series of holes are in axial alignment with at least two of the second series of holes. Energization of the drive means produces movement of the linkage means to cause rotation of the rotatable insulating means and operation of the separable contact means.

BRIEF DESCRIPTION OF THE DRAWINGS

Throughout the several drawings, corresponding reference characters indicate corresponding parts.

DESCRIPTION OF THE PREFERRED EMBODIMENT

Figure 1:
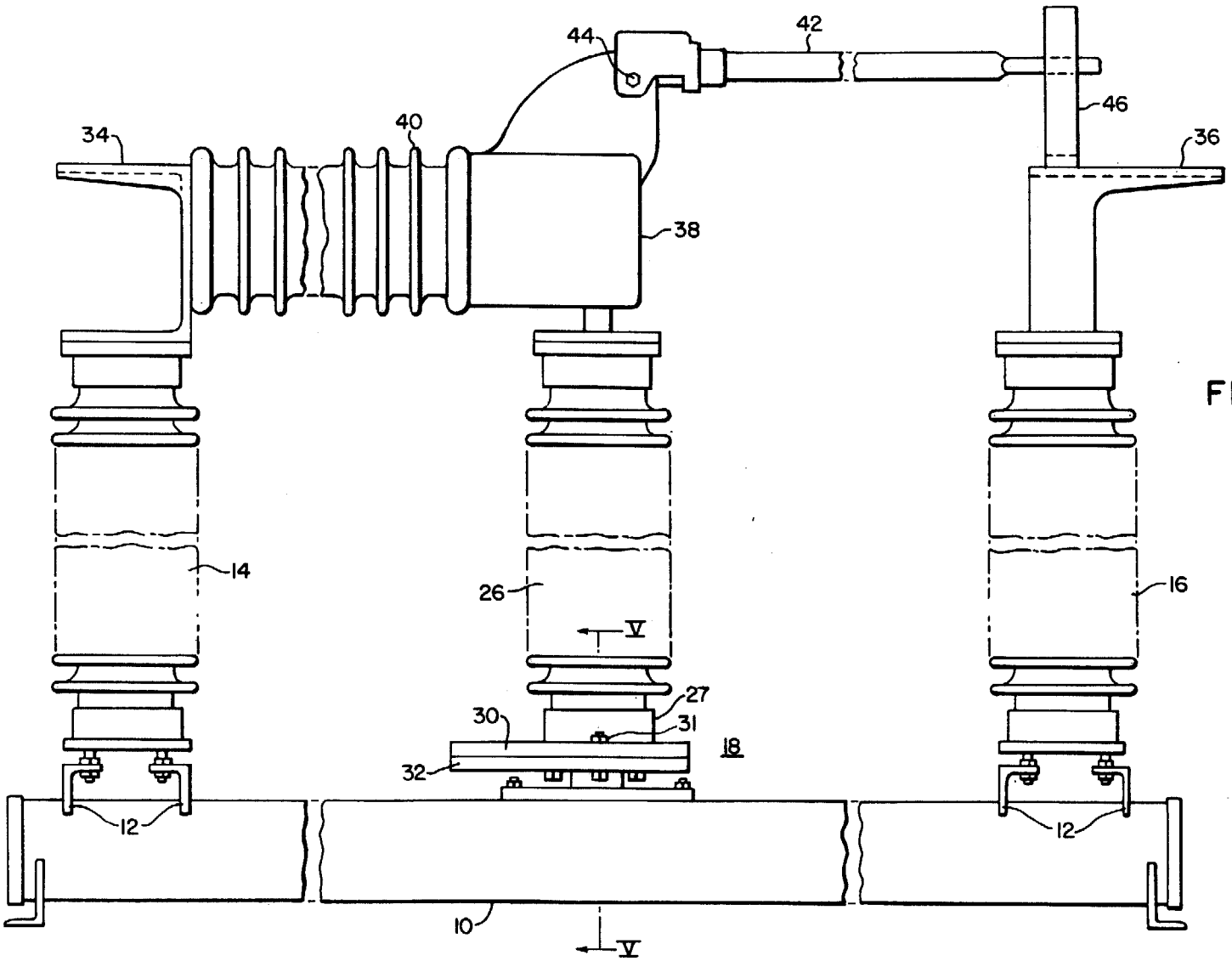
FIG. 1 is a side-elevational view of one pole-unit of a three-phase medium-fault-break disconnecting switch incorporating the principles of the present invention, the device being shown in a closed-circuit position.

The principles of the present invention are embodied in a three-phase medium-fault break disconnect switch, one pole-unit of which is shown generally in FIG. 1. In this device, an interrupter unit is utilized to actually break the load current, while a disconnecting switchblade is swung upward subsequent to operation of the interrupter unit, thus providing a visible open-circuit condition and allowing maintenance personnel to quickly verify the deenergized condition of the line, even from a distance, and work with confidence.

In FIG. 1, mounting brackets 12 are attached to a channel steel base 10 and support two insulating columns 14 and 16. Situated between the columns 14 and 16 on the base 10 is a table assembly 18, shown more clearly in FIG. 5, comprising a rotatable table 20, spindle 22, and support member 24. The rotatable table 20 and attached spindle 22 are held by bearings 23 in the support member 24 and rotate upon a spacer 25. A rotatable insulating column 26 is mounted to the table assembly 18 by mounting bolts 28 which also extend through a synchronizing arm 30 and are threaded into tapped holes of a metal cap 27 of the rotatable insulating column 26. The synchronizing arm and an attached operating arm 32 are secured to the rotating insulator column 26 in a manner to be more fully described later.

Referring again to FIG. 1, a load terminal 34 and a line terminal 36 are mounted upon the insulating columns 14 and 16, respectively. A disconnect mechanism 38 described more fully in U.S. patent application Ser. No. 396,163, filed Sept. 11, 1973 by Stanislaw A. Milianowicz and Russell E. Frink, is mounted atop the rotatable insulating column 26 and supports one end of an interrupter unit 40. The interrupter unit 40, described more fully in U.S. patent application Ser. No. 469,932 filed by Russell E. Frink, is supported at its other end by the load terminal 34. One end of a disconnect switchblade 42 is pivotally connected at 44 to the disconnect mechanism 38. The other end of the disconnect arm 42 is engaged by a switch contact 46 attached to the line terminal 36.

The disconnect mechanism 38 converts the rotational motion of the rotatable insulating column 26 to linear motion operating the interrupter unit 40. From the same motion of the rotatable insulating column 26 the disconnect mechanism 38 produces rotational motion at right angles to the axis of the rotatable insulating column 26, thus swinging the switchblade 42 upwardly, as seen in FIG. 1. In order to produce the proper degree of motion and sequence of operation, it is necessary to obtain precise control of the starting position and amount of angular rotation of the rotatable insulating column 26. This precise control is obtained by adjustment of the operating and synchronizing linkages.

The current path when the medium-fault-break disconnect switch is in the closed position, as shown in FIG. 1, includes the line terminal 36, the switch contact 46, the disconnect switchblade 42, the disconnect mechanism 38, the interrupter unit 40, and the load terminal 34, all at high potential.

Figure 2:
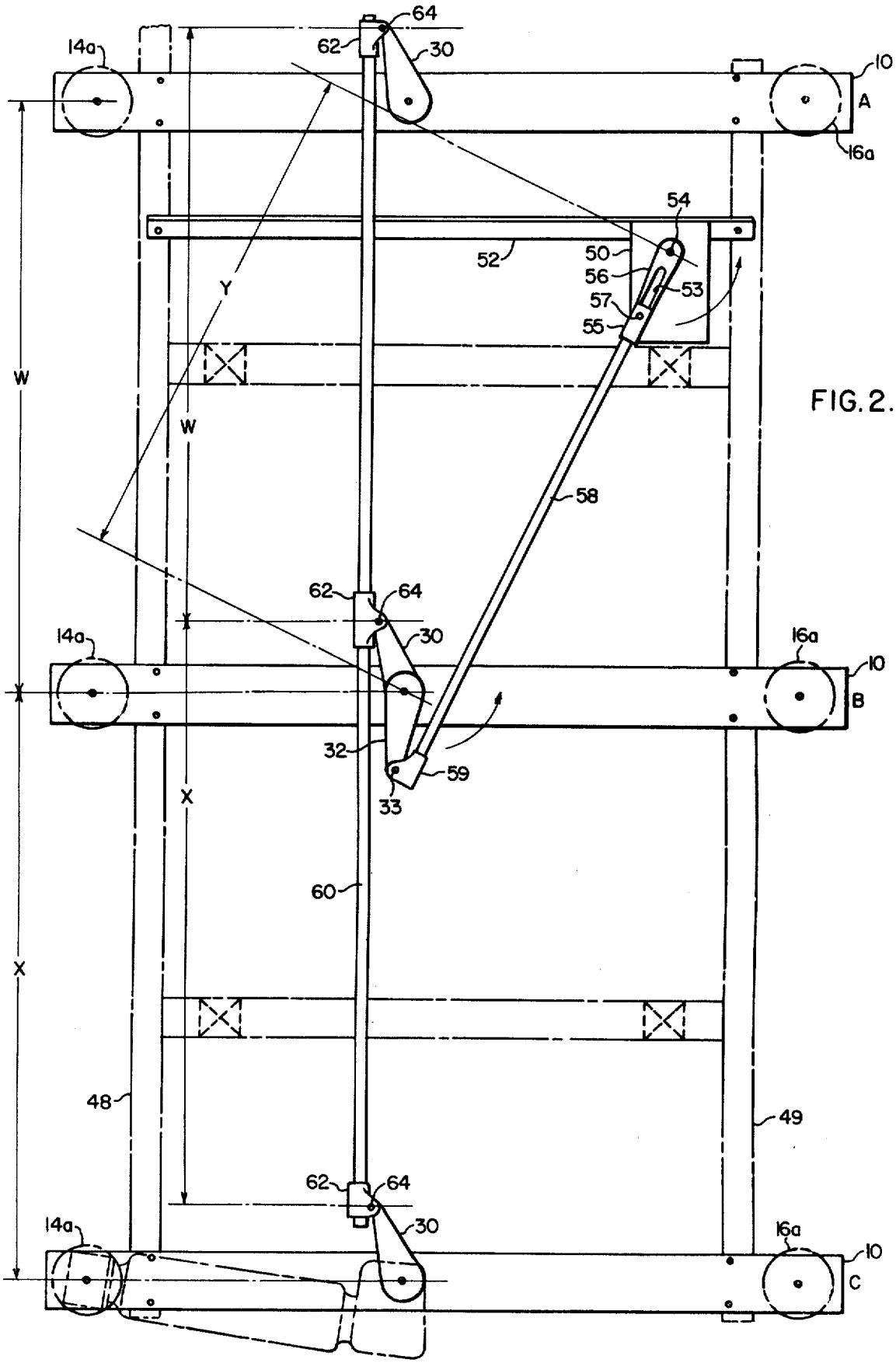
FIG. 2 is a plan view, partially in section, of the medium-fault-break disconnecting switch shown in FIG. 1, showing the linkage and synchronizing mechanisms in a closed-circuit position.

The operating and synchronizing linkages of the switch are shown more clearly in FIG. 2. The base 10 for each phase is mounted upon foundation channels 48 and 49. Insulating columns 14 and 16 for each phase are not shown in FIG. 2, but their position is indicated by the broken circles **14*a* and 16*a*. The rotating insulator columns 26, also not shown in FIG. 2, for each phase are coaxial with the synchronizing arms 30** for the corresponding phase.

Mechanical energy to operate the disconnect switch is provided by a motor-drive 50 secured to a mounting channel 52 and rotating a drive shaft 54. Mounted upon the drive shaft 54 is an adjustable length drive lever 56.

An adjustable length connecting rod 58 is held at one end by a split-tubing clamp 59 pivoted to the operating arm 32 at the point 33 and at the other end by a split-tubing clamp 55 pivotally attached at 57 to the drive lever 56 through a slot 53. The effective length of the drive lever 56 is determined by the point along the slot 53 where the clamp 55 is secured.

Simultaneous operation of all three phases is achieved through the use of a synchronizing mechanism comprising synchronizing arms 30 and a synchronizing connecting rod 60. The synchronizing connecting rod 60 is gripped by split-tubing clamps 62, which are pivotally attached at 64 to the synchronizing arms 30.

In order to operate the disconnect switch from a closed position, as shown in FIGS. 1 and 2 to an open position as shown in FIG. **2*a*, the motor-drive 50 is energized. The drive shaft 54 and attached drive lever 56 rotate approximately 180° in a counterclockwise direction, as viewed in FIG. 2. The drive lever 56, the connecting rod 58, and the operating arm 32 acting in concert with the rigid support structure of the base 10 and foundation channels 48 and 49 constitute a four-bar chain. Thus, counterclockwise rotation of the drive lever 56 produces counterclockwise rotation of the operating arm 32. Since the synchronizing arm 30 of the operated phase B is rigidly attached to the operating arm 32, the synchronizing arm 30 also rotates in a counterclockwise direction, causing, through the action of the synchronizing connecting rod 60, concurrent counterclockwise rotation of synchronizing arms 30 on phases A and C. The synchronizing arms 30, being attached to rotatable insulating columns 26, produce equal counterclockwise rotation of the rotatable insulating columns 26. This rotational motion is transmitted through the disconnect mechanism 38, thereby producing opening operation of the interrupter units 40 and the disconnect switchblades 42** on phases A, B, and C.

Closing operation of the interrupter units and disconnect switch arms is effected by energization of the motor drive 50 producing clockwise rotation of the drive shaft 54 and drive lever 56.

Figure 4:
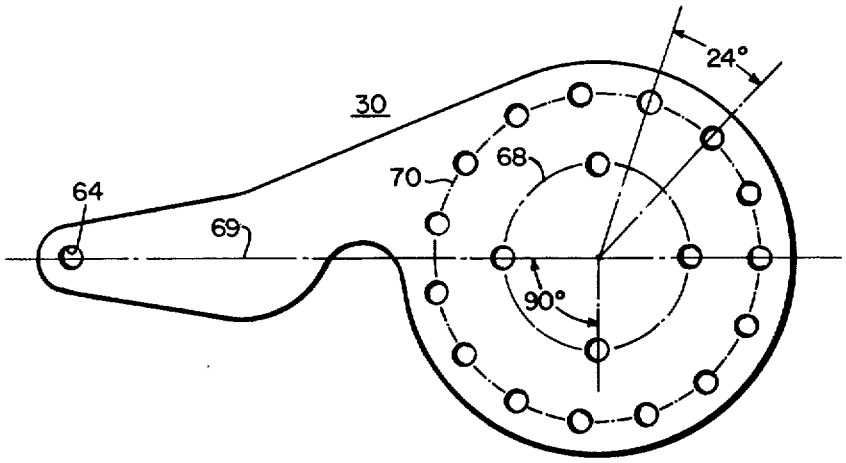
FIG. 4 is a top view of the synchronizing arm.

The synchronizing arm 30, shown more clearly in FIG. 4, has a teardrop shape with an indentation approximately midway between the two ends of the arm to provide clearance for other portions of the mechanism not shown. The narrow end of the synchronizing arm 30 contains a hole 64 for pivotal attachment of the split tube clamp 62. The broad end of the synchronizing arm has two concentric bolt circles 68 and 70, symmetrically disposed with respect to a centerline 69 connecting the center of hole 64 and the center of the two bolt circles 68 and 70. The inner bolt circle 68 contains four holes equally spaced at 90° intervals. The outer circle 70 contains fifteen holes equally spaced at 24° intervals and symmetrically positioned with respect to the centerline 69.

Figure 3:
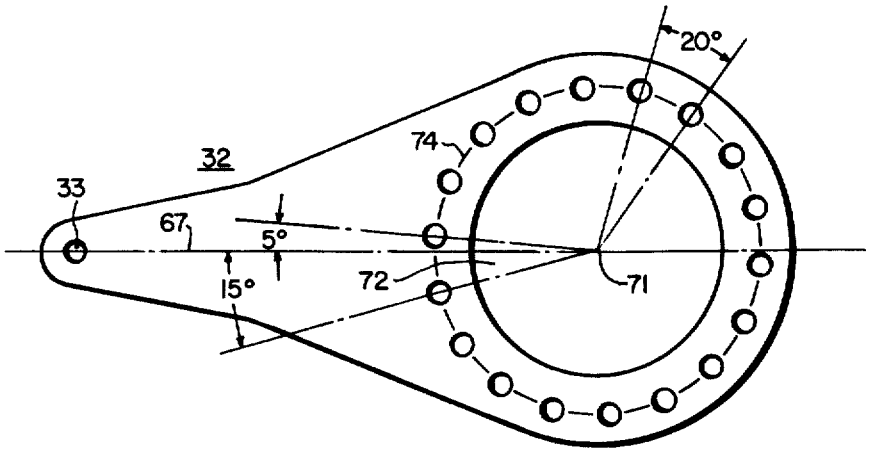
FIG. 3 is a top view of the operating arm.

The operating arm 32 shown in FIG. 3 also has a teardrop shape. The narrow end of the operating arm 32 contains a single pivot hole 33 while a circular aperture 72 of diameter greater than the diameter of the rotatable table 20 is centered at 71 in the broad end of the operating arm 32. Concentrically positioned outside of the circular aperture 72 is a bolt circle 74 of radius equal to the radius of bolt circle 70, in the synchronizing arm 30, having eighteen holes equally spaced at 20° intervals. As shown in FIG. 3, the holes are asymmetrically disposed about the circle 74 with respect to a center line 67 connecting the center of the pivot hole 33 with the center of the circular aperture 72 and bolt circle 74.

Figure 8:
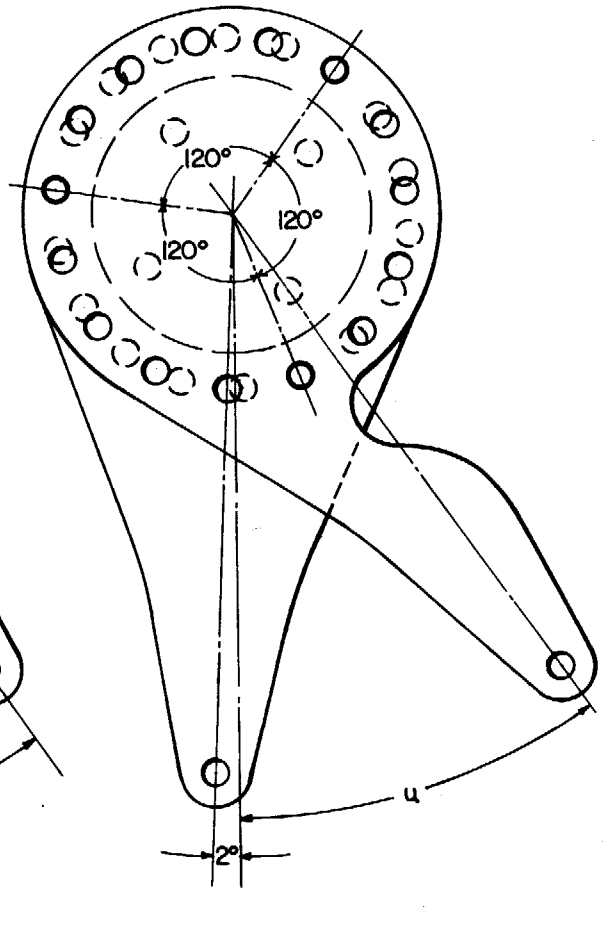
FIGS. 6–8 illustrate the relative positions of the operating arm and synchronizing arm in obtaining small angular adjustment increments and symmetrical bolting patterns when attaching the operating arm to the synchronizing arm.
Figure 7:
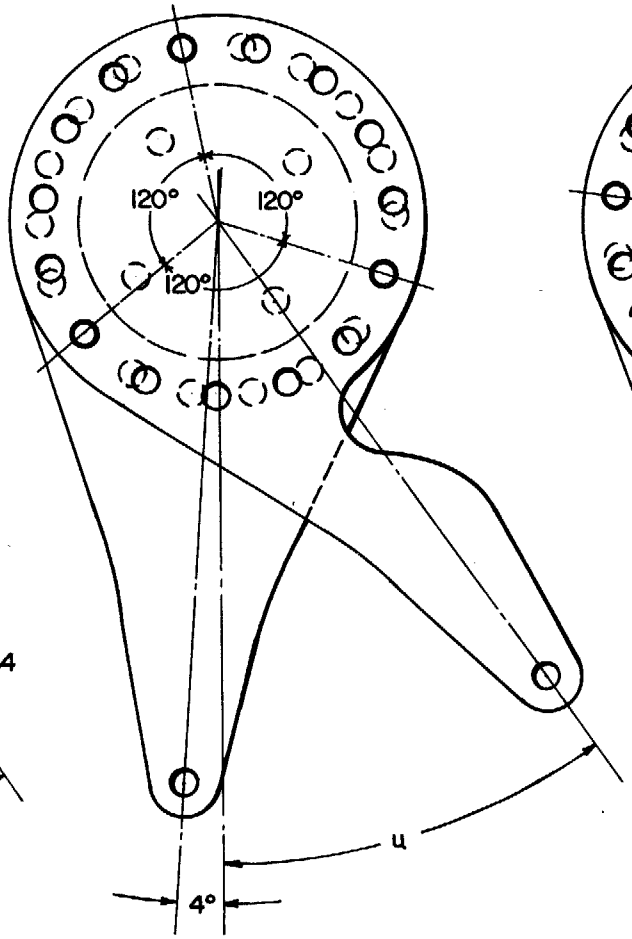
Figure 6:
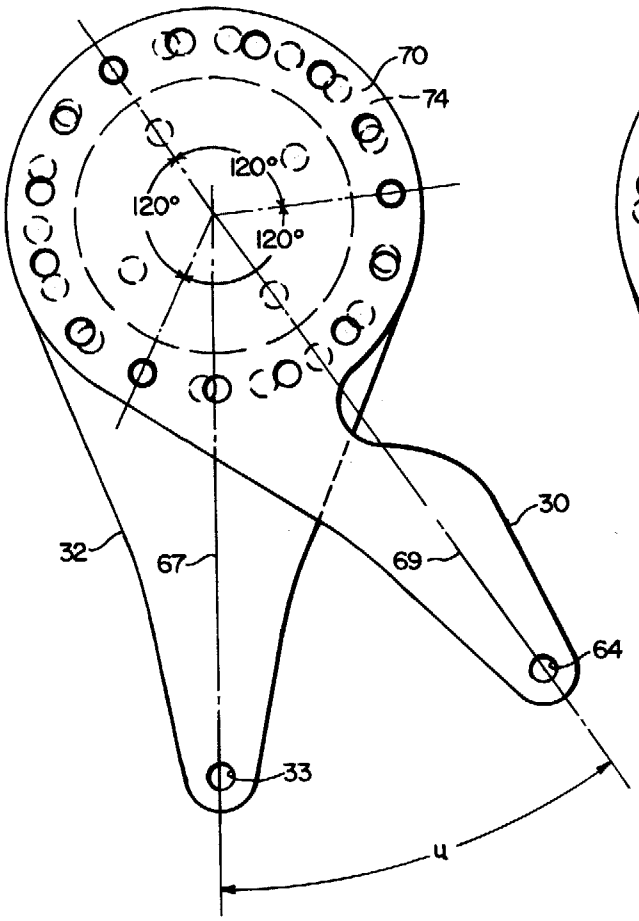

If the operating arm 32 is placed directly underneath the synchronizing arm 30 such that the bolt circles 70 and 74 are in axial alignment and the operating arm 32 is rotated slightly, it will be noted that there are three holes in bolt circle 74 which are in axial alignment with corresponding holes in bolt circle 70, as shown in FIG. 6. These three sets of aligned holes are equally spaced about the bolt circles 70 and 74 and are 120° apart. It will be noted that when the bolt circles 70 and 74 are in axial alignment, their centers are also in axial alignment and that operating arm centerline 67 and synchronizing arm centerline 69 define an angle, "*u*". If, while maintaining the axial alignment of the bolt circles 70 and 74, the operating arm 32 is rotated, it will be noted that when the angle formed by centerline 67 and centerline 69 has changed by 4° as in FIG. 7, three different sets of holes in bolt circle 74 are in axial alignment with corresponding holes in bolt circle 70. Similarly, it will be noted that continued rotation of the operating arm 32 will result in axial alignment of three holes of bolt circles 70 and 74 spaced 120° apart at every 4° increment of rotation. If the arms are positioned in a manner such that three holes of bolt circle 74 are in axial alignment with corresponding holes in bolt circle 70 as described and operating arm 32 is flipped over 180° and positioned in such a manner that the centerline angle is exactly the same as prior to the flipping operation, it will be noted that the three sets of holes are no longer in axial alignment. If, however, the operating arm is rotated exactly 2° as in FIG. 8, it will be noted that once more there are three sets of holes in bolt circles 70 and 74 which are axially aligned. In such a position of alignment, it is possible to rigidly bolt the operating arm 32 to the synchronizing arm 30 and obtain a symmetrical bolting pattern. In the manner described, it is possible to bolt the two arms together at any angle around a 360° circle to a tolerance of plus or minus 1°.

Figure 2A:
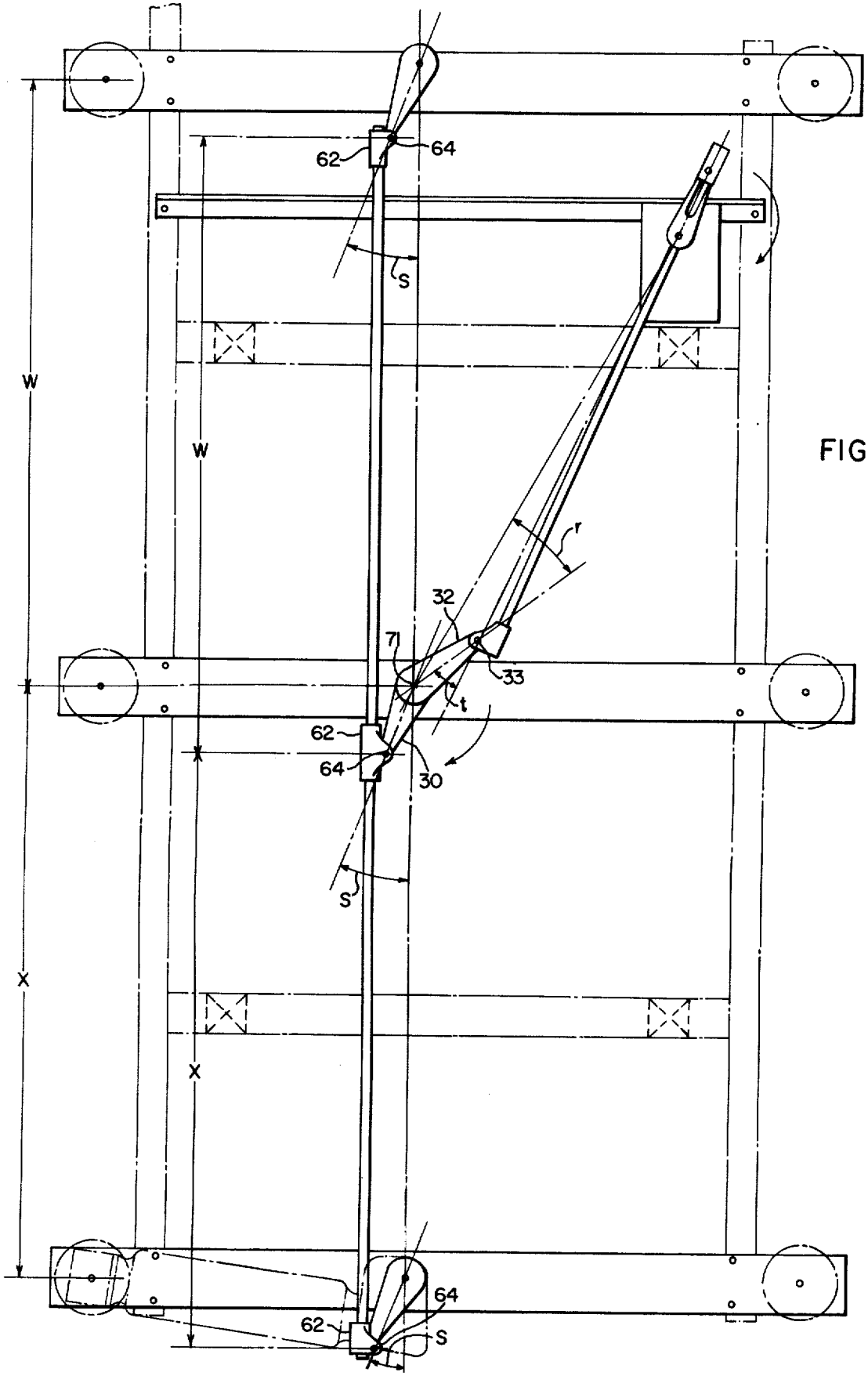
FIG. 2A is similar to FIG. 2 except that the linkage and synchronizing mechanisms are shown in an open-circuit position.

The angle "*t*", FIG. 2A is chosen to be 20° off toggle when the switch is in open position. This provides a favorable mechanical advantage for rotation of the operating arm 32 in a clockwise direction. Since the length of the operating arm 32, that is, the distance from the center 71 of bolt circle 72 to the pivot 33, is known, as well as the angle "*t*", it is possible to compute the angle "*r*", the effective length of the drive lever 56, and the effective length of the connecting rod 58 for a given phase-to-drive length (dimension *y*) and a desired amount of angular travel of the rotatable insulating column 26 for an open-to-close operation.

Setting of the drive lever 56 to the computed effective length is obtained by proper positioning of the clamp 55 in the slot 53. The required length of the connecting rod 58 is obtained by positioning the rod 58 in the clamps 55 and 59 along the rod 58, such that the pivot points 33 and 57 are separated by the computed distance.

Figure 5:
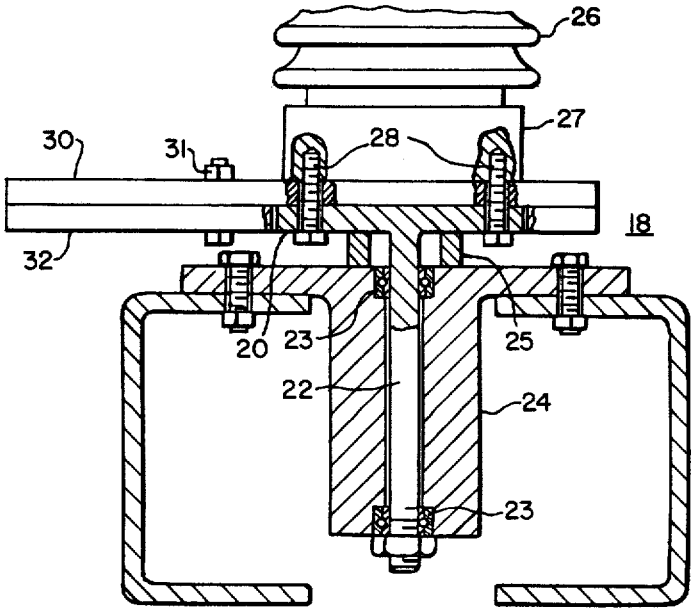
FIG. 5 is an enlarged partial vertical sectional view taken through the rotatable insulating column as indicated by line V—V, FIG. 1.

The assembly details of the rotating insulator column 26, the synchronizing arm 30, the operating arm 32, and the table assembly 18 are shown more clearly in FIG. 5. The operating arm 32 is placed over the rotatable table 20 without attaching it. With the switch in an open position as in FIG. 2A, the synchronizing arms 30 of all three phases are initially set to 20° off toggle, angle "*s*", thus providing a favorable mechanical advantage. A simple fixture is used to set angle "*s*" of the operated phase (phase B) to the required 20° off toggle. The clamp 62 of phase B is then secured to the synchronizing connecting rod 60. By fastening the clamps 62 of phases A and C so that the distance between pivot points 64 is exactly equal to the phase-to-phase distance (dimensions W and X in FIGS. 2 and 2A), the proper value for angle "*s*" of 20° is assured for phases A and C. The four mounting bolts 28 are inserted through holes in the rotatable table 20 and corresponding holes in the four-hole bolt circle 68 of the synchronizing arm 30, then threaded into tapped holes in the cap 27 of the rotatable insulator column 26. Using a suitable fixture, the operating arm 32 is positioned to the proper angle "*r*" as computed in the previously described manner. Slight rotation of the operating arm 32 in either direction will result in axial alignment of three sets of holes in bolt circle 70 and bolt circle 74, as previously described. If the position of the operating arm 32 with three sets of holes in axial alignment does not result in a fixture angle "*r*" within plus or minus 1° of the computed angle "*r*", the operating arm 32 is flipped over 180° after disengaging the mounting bolts 28. Slight adjustment of the operating arm 32 in this flipped over position will now result in axial alignment of three sets of holes, such that the angle "*r*" is within plus or minus 1° of the computed angle "*r*". Three bolts 31 can now be inserted through the three axially aligned holes, thus securing the operating arm 32 to the synchronizing arm 30 in the desired angular position. The synchronizing arm 30 thus acts as a flange member for attaching the operating arm 32 to the rotatable insulation column 26 at the desired angular position.

Plus or minus 1° is a much closer tolerance than is possible using prior methods of bolting which employed bolt circles or segments thereof in which the hole spacing of one bolt circle is equal to the hole spacing in the other bolt circle. By using the unequal spacing, as employed in the present invention, it is possible to obtain a high degree of angular resolution while at the same time employing smaller operating and synchronizing arms. These smaller components have the advantage of reducing the rotational inertia of the mechanism and decreasing the operation time for the entire switch.

The length of the connecting rod 58 and the drive lever 56 can now be set to the computed length through adjustment of the clamps 59 and 55. In this manner, setup of the entire switch can be accomplished using a well-defined procedure, eliminating tedious trial and error methods involved in the prior art. The use of these trial and error techniques often required several days of effort by a skilled team of installers from the supplier of the switch. The use of the present invention allows installation of the switch by a customer unfamiliar with the switch. It is possible to install and set up a switch such as claimed herein in a period of less than one day, resulting in substantial reduction of installation cost. The reduced size of the arm assembly results in a lower material cost, as well as decreased operation time of the switch due to the lower rotational inertia of the smaller size components. An operating arm and synchronizing arm flange member as described can be cut and punched from plate metal, avoiding expensive casting or machining procedures as is necessary for the tooth and clamp method of prior art.

From the foregoing, it is evident that there has been described a high voltage switch providing decreased operation time, a finer degree of adjustment, lower material and fabrication cost, and a lower installation cost.

We claim:

1. A high-voltage switch comprising:

a. separable contact means;

b. rotatable insulating means supporting said separable contact means, rotation of said rotatable insulating means producing separation of said contact means;

c. energizable drive means;

d. linkage means connected to said drive means for rotating said rotatable insulator means; and e. an arm assembly, said arm assembly comprising an operating arm connected to said linkage means, said operating arm having a first series of holes equally spaced about a first circle, said arm assembly comprising a flange member attached to said rotatable insulating means and having a second series of holes equally spaced about a second circle of radius substantially equal to said first circle, the spacing of said first series of holes being unequal to the spacing of said second series of holes, said operating arm being attached to said flange member and so positioned that the centers of said first circle and said second circle are in axial alignment and at least two of said first series of holes are in axial alignment with at least two of said second series of holes to form at least two pairs of aligned holes symmetrically disposed about said circles, said arm assembly also comprising a plurality of means for securing said operating arm in fixed relationship to said flange member, each of said securing means extending through both holes of an aligned hole pair;

f. energization of said drive means producing movement of said linkage means to cause rotation of said rotatable insulating means and operation of said separable contact means, said symmetrical disposition of said aligned hole pairs about said circles causing rotational loads produced by energization of said drive means to be symmetrically imposed upon said flange member.

2. A high voltage switch as claimed in claim 1 wherein said first series of holes is asymmetrically disposed about said first circle with respect to a line connecting the center of said first circle with the point of connection between said linkage means and said operating arm.

3. A high voltage switch as claimed in claim 1 wherein said first series of holes contains 18 holes equally spaced around said first circle and said second series of holes contains 15 holes equally spaced around said second circle.

4. A multiphase high-voltage switch comprising:

a. separable contact means:

b. rotatable insulating means supporting said separable contact means, rotation of sair rotatable insulator means producing separation of said contact means;

c. drive means for rotating said rotatable insulating means;

d. linkage means connected to said drive means; and e. an arm assembly, said arm assembly comprising an operating arm connected to said linkage means, said operating arm having a first series of holes equally spaced about a first circle, said arm assembly also comprising a synchronizing arm attached to said rotatable insulator means and having a second series of holes equally spaced about a second circle of radius substantially equal to said first circle, the spacing of said first series of holes being unequal to the spacing of said second series of holes, said operating arm being attached to said synchronizing arm and so positioned that the centers of said first circle and said second circle are in axial alignment and at least two of said first series of holes are in axial alignment with at least two of said second series of holes to form at least two pairs of axially aligned holes symmetrically disposed about said circles, said arm assembly also comprising a plurality of means for securing said operating arm in fixed relationship to said synchronizing arm, each of said securing means extending through both holes of an aligned hole pair;

f. energization of said drive means producing rotation of said rotatable insulating means and operation of said separable contact means, said symmetrical disposition of said aligned hole pairs about said circles causing rotational loads produced by energization of said drive means to be symmetrically imposed upon said synchronizing arm.

5. An arm assembly for producing rotational motion in a multiphase high-voltage switch comprising an operating arm having a first series of holes equally spaced about a first circle, and a synchronizing arm having a second series of holes equally spaced about a second circle of radius substantially equal to the radius of said first circle, the spacing of said first series of holes being unequal to the spacing of said second series of holes, said operating arm being attached to said synchronizing arm and so positioned that the centers of said first and second circles are in axial alignment and at least two of said first series of holes are in axial alignment with at least two of said second series of holes to form at least two pairs of axially aligned holes symmetrically disposed about said circles, said arm assembly also comprising a plurality of means for securing said operating arm in fixed relationship to said synchronizing arm, each of said securing means extending through both holes of an aligned hole pair, said symmetrical disposition of aligned hole pairs about said circles resulting in symmetrical imposition of rotational loads upon said operating arm and said synchronizing arm when force is transmitted through said arm assembly.

6. An arm assembly as recited in claim 5 wherein said first series of holes contains 18 holes equally spaced around said first circle and said second series of holes contains 15 holes equally spaced around said second circle, thereby forming three pairs of aligned holes symmetrically spaced at 120° intervals about said circles.

* * * * *